US011885131B2

(12) United States Patent
Nelson

(10) Patent No.: US 11,885,131 B2
(45) Date of Patent: Jan. 30, 2024

(54) CEILING TILE CONTROL AND GRID SUPPORT CLIP

(71) Applicant: American Retention Components, Inc., Ocala, FL (US)

(72) Inventor: Nicholas M. Nelson, Ocala, FL (US)

(73) Assignee: American Retention Components, Inc., Ocala, FL (US)

( * ) Notice: Subject to any disclaimer, the term of this patent is extended or adjusted under 35 U.S.C. 154(b) by 252 days.

(21) Appl. No.: 17/515,082

(22) Filed: Oct. 29, 2021

(65) Prior Publication Data

US 2022/0136245 A1 May 5, 2022

Related U.S. Application Data

(60) Provisional application No. 63/111,150, filed on Nov. 9, 2020, provisional application No. 63/108,078, filed on Oct. 30, 2020.

(51) Int. Cl.

| | |
|---|---|
| ***E04B 9/24*** | (2006.01) |
| ***E04B 9/18*** | (2006.01) |
| ***E04B 9/06*** | (2006.01) |

(52) U.S. Cl.

CPC ..... *E04B 9/242* (2013.01); *E04B 9/067* (2013.01); *E04B 9/183* (2013.01)

(58) Field of Classification Search

CPC ..... E04B 9/242; E04B 9/067; E04B 9/183; E04B 9/127

See application file for complete search history.

(56) References Cited

U.S. PATENT DOCUMENTS

| | | | | |
|---|---|---|---|---|
| 3,077,057 A * | 2/1963 | Forkin | E04B 9/22 | 52/353 |
| 3,207,057 A * | 9/1965 | Brown | E04B 9/242 | 454/301 |
| 3,834,106 A * | 9/1974 | Astedt | E04B 9/242 | 52/715 |
| 4,033,079 A * | 7/1977 | Cross, Jr. | E04B 9/241 | 403/17 |
| 4,074,885 A * | 2/1978 | Hacker, Jr. | E04B 9/006 | 24/326 |

(Continued)

OTHER PUBLICATIONS

USG Suspension Systems Accessories Grid Installation Catalog, Order Samples/Literature; USG: sampleitusg.com, © 2020 AWI Licensing LLC, 4 pps.

*Primary Examiner* — Rodney Mintz
(74) *Attorney, Agent, or Firm* — Foley & Lardner LLP

(57) ABSTRACT

A clip for use with a runner of a drop ceiling including a first half with a first support section comprising a first fastener aperture and a first support aperture, a first control section configured to contact the adjacent first ceiling tile, and a first retaining section below the first section comprising a first retaining tab configured to impede the travel of a first side of a bulb. The clip further includes a second half with a second support section comprising a second fastener aperture and a second support aperture, a second control section configured to contact the adjacent second ceiling tile, a second retaining section comprising a second retaining tab configured to grip a second side of the bulb, the second side opposite the first side, a fastener to couple the first half to the second half, a support element to couple the clip to an external support.

19 Claims, 10 Drawing Sheets

(56) References Cited

U.S. PATENT DOCUMENTS

| | | | | |
|---|---|---|---|---|
| 4,408,428 | A | 10/1983 | Brooke et al. | |
| 4,873,809 | A * | 10/1989 | Paul | E04B 9/242 52/506.07 |
| 4,967,530 | A * | 11/1990 | Clunn | E04B 9/242 52/204.591 |
| 5,033,247 | A * | 7/1991 | Clunn | E04B 9/02 52/204.591 |
| D421,897 | S | 3/2000 | Washecheck et al. | |
| 6,701,686 | B1 * | 3/2004 | Platt | E04B 9/02 52/506.07 |
| 7,062,886 | B2 | 6/2006 | Auriemma | |
| 8,997,426 | B1 * | 4/2015 | McLeod | E04B 9/242 52/774 |
| 9,745,746 | B2 * | 8/2017 | Heesbeen | E04B 9/24 |
| 9,976,303 | B2 * | 5/2018 | Gloftis | E04B 9/183 |
| 11,506,349 | B2 * | 11/2022 | Porciatti | E04B 9/18 |
| 2005/0060850 | A1 * | 3/2005 | Auriemma | E04B 9/242 24/545 |
| 2016/0251855 | A1 * | 9/2016 | Heesbeen | E04B 9/24 52/506.05 |
| 2017/0044767 | A1 * | 2/2017 | Gloftis | E04B 9/225 |
| 2021/0348730 | A1 * | 11/2021 | Porciatti | F21S 4/28 |
| 2023/0015651 | A1 * | 1/2023 | Nilsson | E04B 9/183 |

* cited by examiner

CEILING TILE CONTROL AND GRID SUPPORT CLIP

CROSS-REFERENCE TO RELATED APPLICATIONS

This application claims the benefit of U.S. Provisional Patent Application No. 63/108,078, filed Oct. 30, 2020, and U.S. Provisional Patent Application No. 63/111,150, filed Nov. 9, 2020, the contents of which are hereby incorporated by reference in their entireties.

TECHNICAL FIELD

The present disclosure relates to drop ceilings and the "T-Bar" support structure often used as part of a drop ceiling system. More specifically the disclosure relates to one or more clips that may be used in combination with an external support to provide additional support to the "T-Bar" support structure of the drop ceiling system and to prevent inadvertent or unintended movement of the ceiling tiles from the desired position or location within the drop ceiling system.

DETAILED DESCRIPTION

Referring generally to the figures, a clip is integrated for use in conjunction with a runner as part of a drop ceiling system. The clip is intended to provide the dual benefit of providing a spring for holding the ceiling tiles in the desired position, while also providing a suitable adjustable means for providing additional support to the T-shaped grid. With such adjustable support, the T-shaped grid is better adapted to support items hung from or otherwise supported by the T-shaped grid such as signs, banners, promotional materials or even decorative items such as plants.

While the many components shown and described herein are made with reference to a drop ceiling system, it should be understood that the clip may be used in combination with other ceiling types and structural components. For example, the clip may be used in combination with a coffered ceiling, a conventional ceiling, a shed ceiling, a tray ceiling, etc.

Before turning to the figures, which illustrate certain example embodiments in detail, it should be understood that the present disclosure is not limited to the details or methodology set forth in the description or illustrated in the figures. It should also be understood that the terminology used herein is for the purpose of description only and should not be regarded as limiting.

Figure 1:
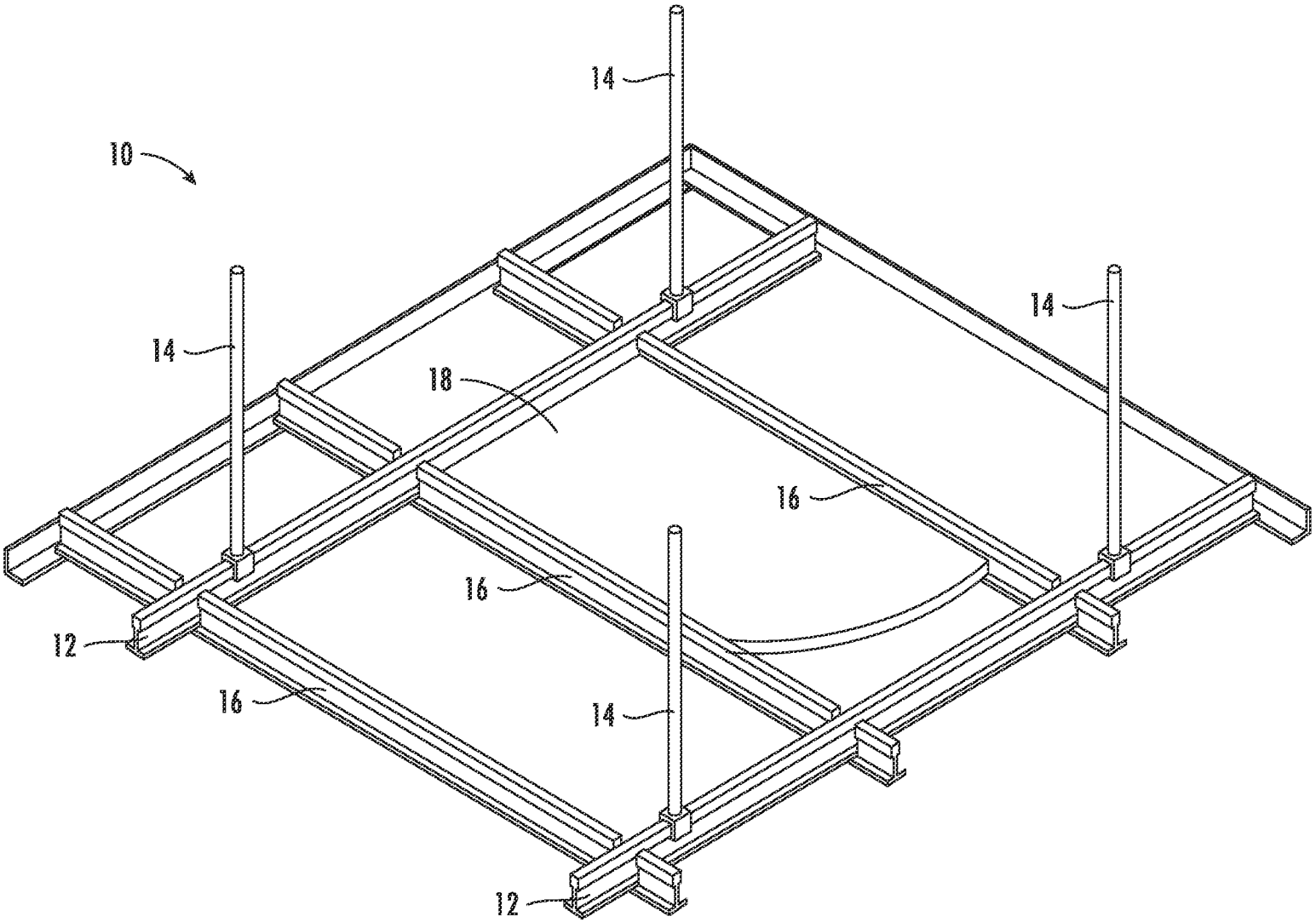
FIG. 1 is a perspective view of a drop ceiling system, according to an example embodiment.

Referring to FIG. 1, a drop ceiling system 10 (i.e., suspended ceiling, grid ceiling, T-bar ceiling, etc.) is shown, according to an example embodiment. The drop ceiling system 10 includes a support grid or framework comprising multiple main runners 12, multiple cross runners 16 intersecting the main runners 12 and one or more ceiling tiles 18 supported by the framework created by the main runners 12 and cross runners 16. Preferably, each main runner 12 is supported by and coupled via multiple wires 14 or other suitable support element to a support structure of the building or facility in which the drop ceiling system is located, however, the number of main runners which are physically connected to the facility support structure is a matter of design. Preferably, each main runner 12 extends the full length or width of the room and have one or more sections in which the cross runners 16 couple to the main runners; however, it is not necessary that the main runners span the entire length or width of the room. Similarly each cross runner 16, preferably extends the full length or width of the room (or a portion of the length or width of the room) and couples to multiple main runners 12 (e.g., one main runner 12 at each end of the cross runner 16). Both the main runners 12 and the cross runners 16 are preferably made from extruded aluminum, but may be made of any suitable material (e.g., lightweight metal or thermoplastic) which provides sufficient strength to the framework and provides suitable aesthetics in the assembled state. The main runners 12 and the cross runners 16 preferably have a cross-section of an inverted "T," when looking from the view of FIG. 1 (e.g., from above the drop ceiling system 10). The main runners 12 and the cross runners 16 are conventionally referred to therefore as "T-bars." As a result, each cross runner 16 and each main runner 12 typically includes a flange projecting substantially horizontally and a vertical web extending upwardly from the horizontally projecting flange.

When the cross runners 16 are coupled to the main runners 12, the various horizontally projecting flanges of the cross runner 16 and the main runners 12 are ideally suited to receive and support one or more ceiling tiles 18. The ceiling tiles 18 are typically made of a variety of lightweight materials including closed and open cell foam. In this way, the ceiling tiles 18 sit within the grid work of the drop ceiling system 10 and provide a visually pleasing appearance for an observer positioned beneath the drop ceiling system 10. This structure hides from view the many components typically located above the drop ceiling system 10 (e.g., the heating, ventilation, and air conditioning (HVAC), electrical wiring, etc.) which are not generally supported by the drop ceiling system 10.

Figure 2:
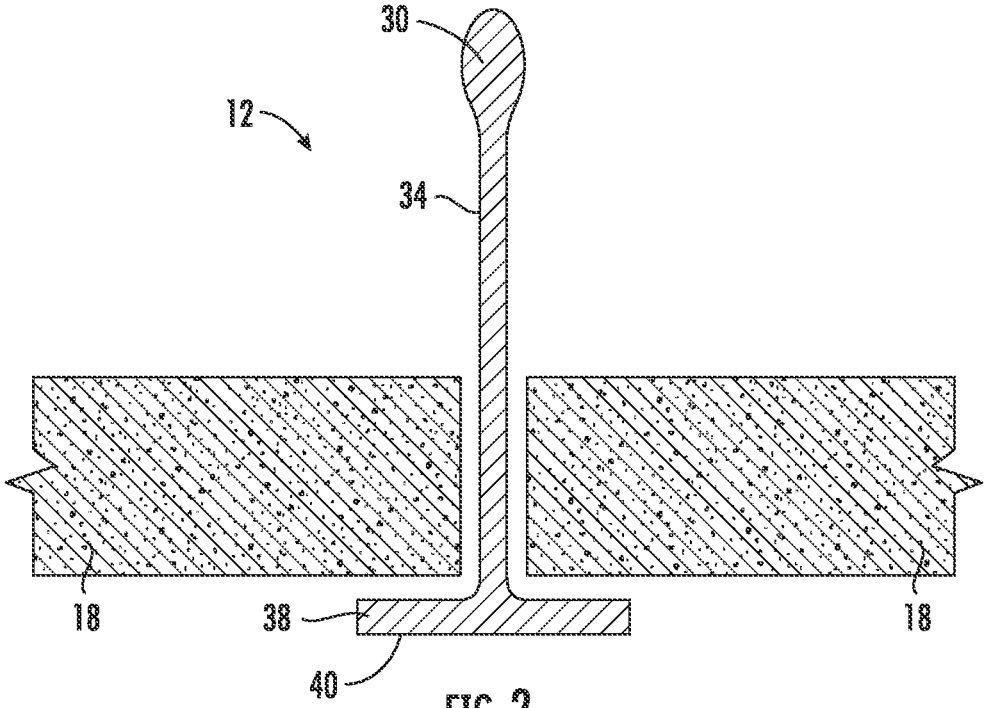
FIG. 2 is a cross-sectional view of a main runner of the drop ceiling of FIG. 1, according to an example embodiment.

Referring now to FIG. 2, a cross-sectional view of one of the main runners 12 is shown, according to an example embodiment. As described herein, each main runner 12 has a cross-section that is generally an inverted "T" and as a result comprises multiple portions such as a vertical web 34 with a bulb or bead 30 formed at or near the top of the web 34 and a horizontal flange 38 provided at or near the bottom edge of the web 34. Preferably, the bulb 30 is located at the top of the main runner 12 and has increased thickness (e.g., increased horizontal width) as compared to the remainder of the vertical web 34. In one embodiment, the bulb 30 may have a relatively circular or round cross section. Any other shape or cross section (e.g., rectangular, square, triangular, etc.) may be used, the most important element being that the bulb is relatively wider than the portion of the web immediately below the bulb. The bulb 30 provides structural support and rigidity to the main runner 12. As the main runners 12 are commonly thin (e.g., 1/32 of an inch thick at the vertical web 34) and made of lightgauge metals such as aluminum or steel, the main runners 12 benefit from additional structural support and rigidity. The bulb 30 provides this structure acting as a point of increased width to provide structural support to the vertical web 34.

As described herein, the vertical web 34 is preferably relatively thin and extends downward from the bulb 30 to the horizontal flange 38. The flange 38 extends horizontally outwardly from the vertical web 34 forming two portions on opposite sides of the vertical web 34 adapted to receive and support ceiling tiles 18. The exposed surface or face 40 of the horizontal flange 38 can be contoured or configured into any number of aesthetically desirable surfaces. In some embodiments, the face 40 may be approximately 1.5 inches in width. In other embodiments, the face may be approximately within the range of 0.75-1.25 inches in width.

While FIG. 2 depicts ceiling tiles 18 supported by the main runners 12, it should be understood that a cross-section of the cross runners 16 would be essentially the same as that depicted in FIG. 2. Therefore, it should be understood that all references to the main runners 12 may be applied to the cross runners 16.

During typical installation of a drop ceiling system 10, the main runners 12 are installed first and hung via the wires 14 from the support structure above the drop ceiling system 10. Next, the cross runners 16 may be coupled to the main runners 12, and finally the ceiling tiles 18 are placed within the drop ceiling system 10 and supported by the flanges 38 (as described herein). Once installed, the drop ceiling system 10 may need to be modified or adopted to support additional weight hung from T-grid.

Figure 3:
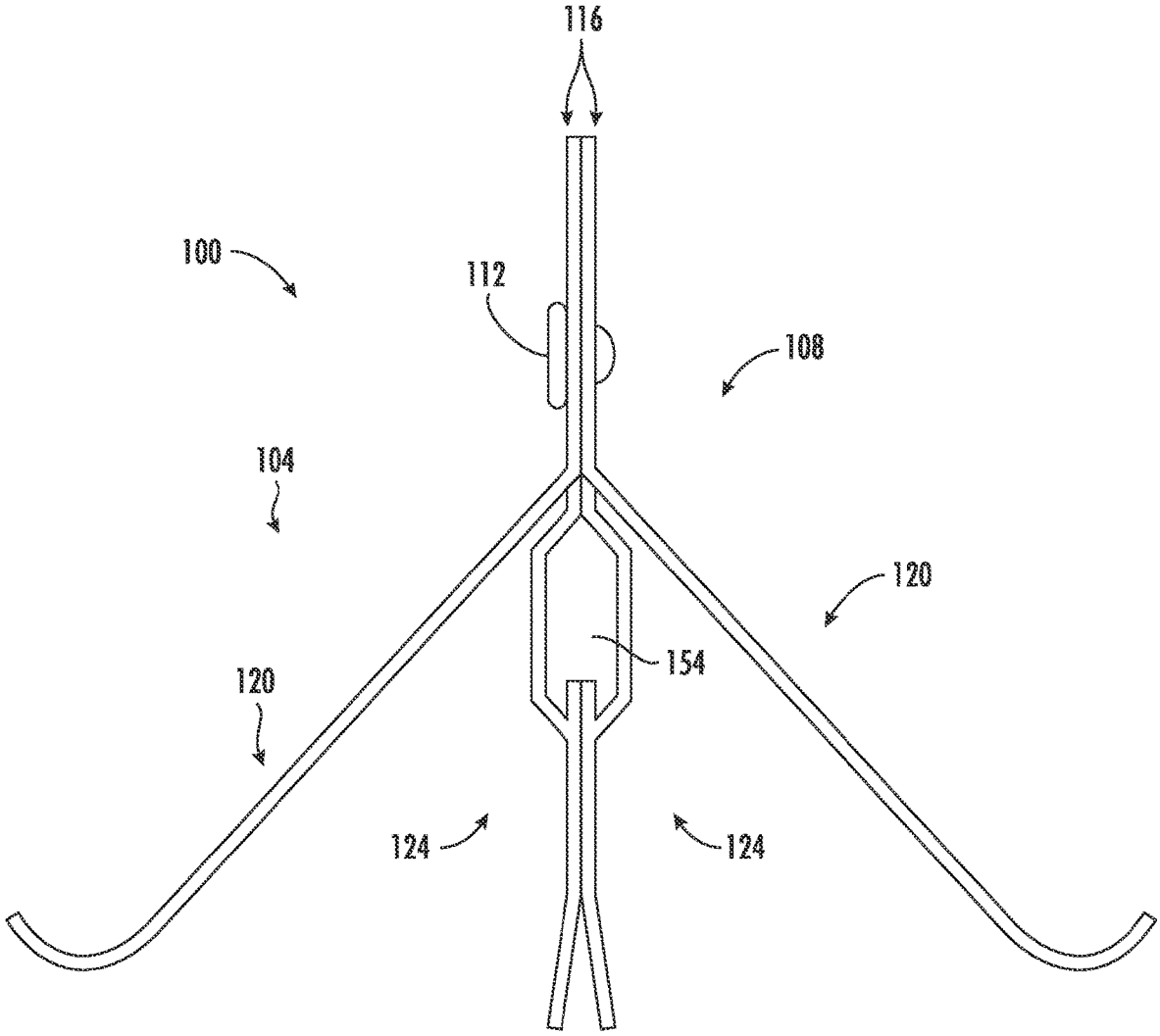
FIG. 3 is a side view of a ceiling tile control and grid support clip, according to an example embodiment.

Referring to FIG. 3, one option for increasing the relative weight or load which can be supported by the drop ceiling system 10 is shown as a ceiling clip 100, according to an example embodiment. The ceiling clip 100 is a clip that is configured to couple to either one of the main runners 12 or one of the cross runners 16 to provide means for additional structural connection or support between the grid and the facility support structure and provide a means for retaining, in place, multiple ceiling tiles 18. To do so, the ceiling clip 100 includes a first half 104 coupled to a second half 108 by a fastener 112 to form a hollow, recess or cavity 154 between the first half 104 and the second half 108. Preferably, the first half 104 and the second half 108 are structurally identical to one another and adapted to be assembled back to back by the fastener 112. The fastener 112 may be any kind of fastener such as a screw, a nut and a bolt, a threaded bolt and threads, a rivet, a nail, etc. Similarly, the fastener 112 is received within a suitable aperture formed in each of the first half 104 and second half 108 and provides a strong coupling to the first half 104 and the second half 108 such that a spring force is created within each as will be discussed further herein. An alternative to a fastener which can be used is a more permanent means for attaching the first and second halves such as welding or industrial adhesive. The cavity 154 is formed between the first half 104 and the second half 108 and, in use, receives the bulb 30 and a portion of the vertical web 34 of a runner. In this way, the cavity 154 acts to receive and retain the runner to couple the ceiling clip 100 to the runner.

Still referring to FIG. 3, the first half 104 and the second half 108 are each shown to include a first section in the form of a support section 116, a second section in the form of a ceiling tile control section or spring arm 120, and a third section in the form of a bulb retention section 124. The support section 116 is configured to receive the fastener 112 to couple the first half 104 and the second half 108 to one another as well as receive a wire or hanger to couple the ceiling clip 100 to the support structure of the facility located above the drop ceiling system 10 (e.g., the same support the wires 14 are coupled to). The spring arm 120 is configured to contact the upper surface of an installed ceiling tile 18. In use, the spring arm 120 resists, but doesn't prevent movement of the ceiling tile. If the ceiling tile 18 is inadvertently bumped or moved, the spring arm 120 will deform to allow movement of the displaced tile until the force moving the tile is released and the spring arm 120 will bias the ceiling tile back into the desired location. However, if a user needs to gain access to the space above the grid, the user can exert sufficient force to overcome the force of the spring arm 120 to push up on the ceiling tile a sufficient amount and remove the tile from its installed position. Lastly, the two opposed bulb retention sections 124 cooperate to form the cavity 154 and engage or grip the bulb 30 of the main runner 12 or the cross runner 16 to both hold the ceiling clip 100 in place and provide a suitable means for providing additional connection points between the grid and the clip 100. The bulb retention sections 124 are tapered at a first end away from the support section 116 to allow bulb 30 to be pressed between the bulb retention sections 124 and push between the first half 104 and the second half 108 into cavity 154.

Figure 4:
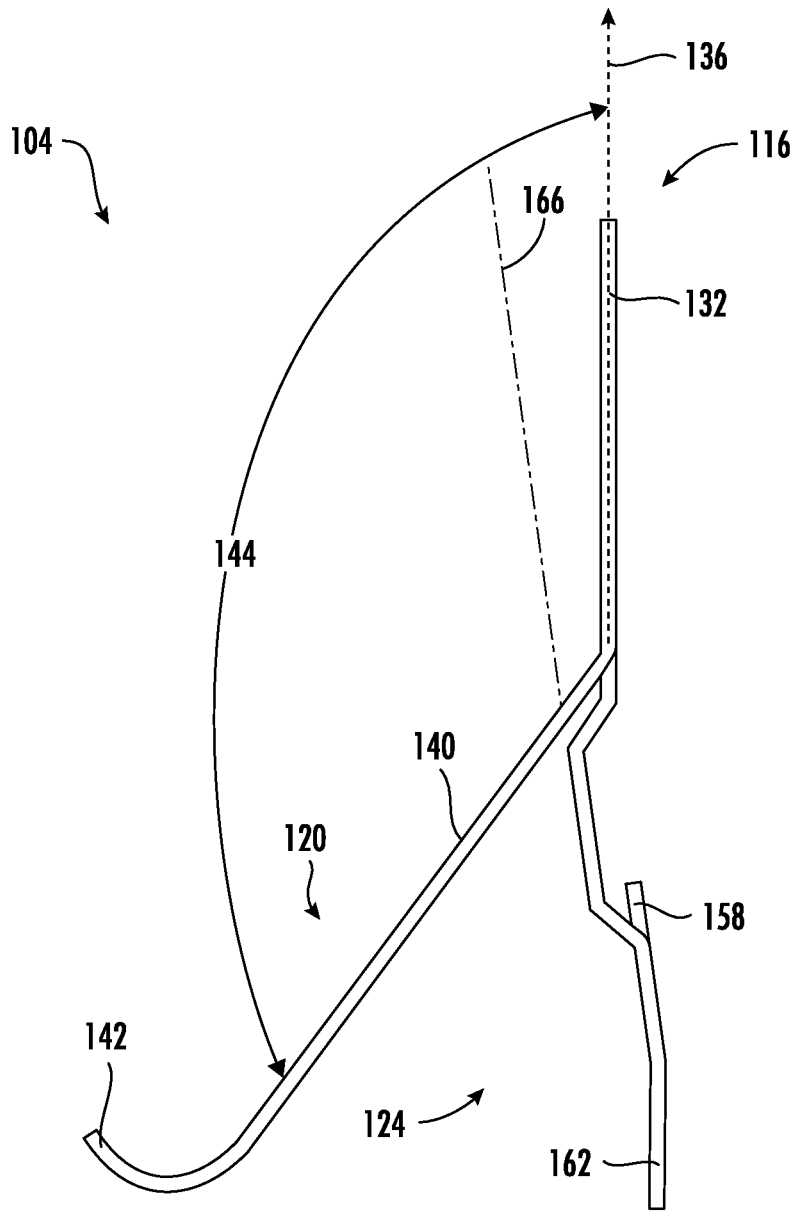
FIG. 4 is a side view of a first half of the ceiling tile control and grid support clip of FIG. 3.
Figure 5:
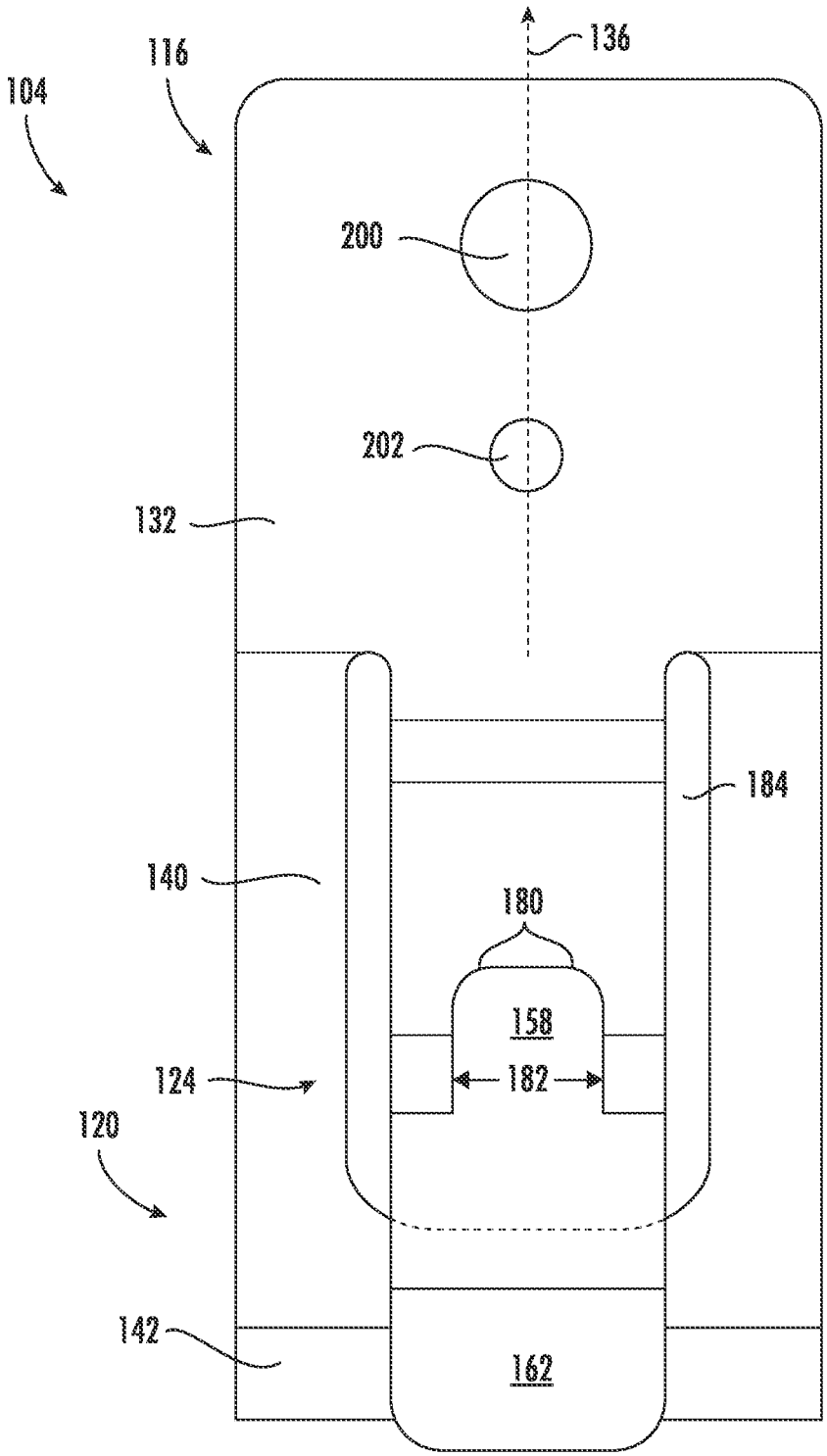
FIG. 5 is a rear view of the first half of the ceiling tile control and grid support clip of FIG. 3.
Figure 6:
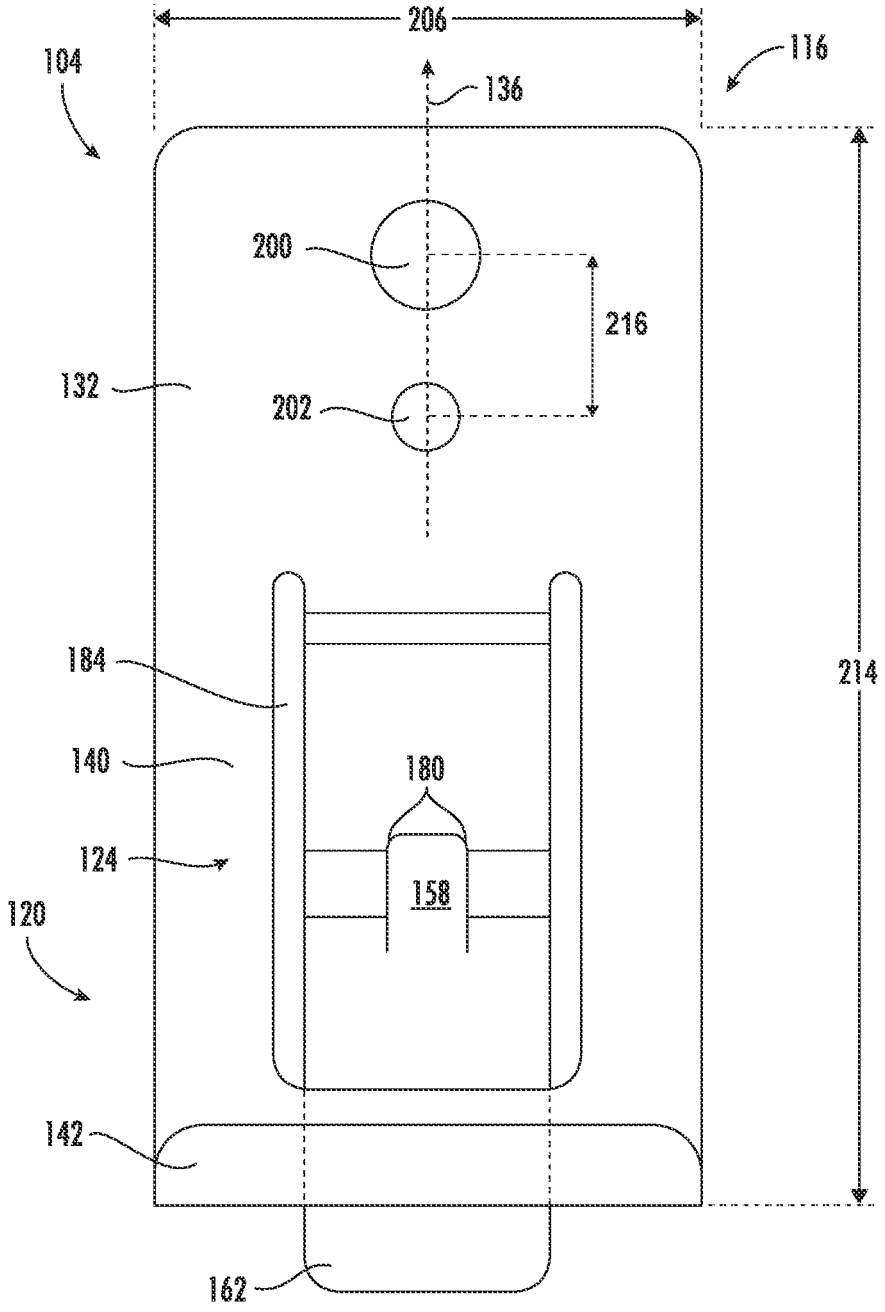
FIG. 6 is a front view of the first half of the ceiling tile control and grid support clip of FIG. 3.

Referring now to FIGS. 4-6, the first half 104 of the ceiling clip 100 is shown in further detail. FIG. 4 shows a side view of the first half 104, FIG. 5 shows a front view of the first half 104 (with the bulb retention section 124 coming toward the view and the spring arm 120 going away from the view of FIG. 5), and FIG. 6 shows a rear view of the first half 104 (with the spring arm 120 coming toward the view and the bulb retention section 124 going away from the view of FIG. 6). As described herein, while reference is made to the first half 104 all sections, portions, and components of the first half 104 may be applied and made to the second half 108.

Referring generally to FIGS. 4-6, the first half 104 is preferably manufactured from a single sheet of metal that is processed by a metal stamp and die set. In this way, the first half 104 is manufactured in a single step during which the metal sheet is stamped, cut and bent to the desired shape. The resulting support section 116 is typically a relatively lightly processed section (e.g., no significant stamping), while the spring arm 120 and the bulb retention section 124 are formed through the cutting, stamping and bending process. For example, the bulb retention section 124 is preferably cut from what becomes the spring arm 120. As a result, the spring arm 120 is wider than the bulb retention section 124 and includes a hollow portion or aperture 184 formed therein where the bulb retention section 14 was cut and stamped. The hollow aperture 184 preferably has rounded corners which can reduce the stress on the manufacturing equipment when cutting the bulb retention section 124. Through the cutting and stamping process a single integral sheet of metal is formed into the many sections and portions that the first half 104 is shown to include, however other suitable manufacturing methods can be used. As a result, each of the sections (e.g., the support section 116, the spring arm 120, and the bulb retention section 124) and the portions thereof typically include the same thickness. In some embodiments, the thickness is approximately 0.028 inches. In other embodiments, the thickness of each of the sections may be approximately within the range of 0.015-0.030 inches. Additionally, the first half 104 is preferably made of 1050 annealed steel (i.e., spring steel), but the first half 104 may be made of any suitable material (e.g., 1075 annealed steel, 1080 annealed steel, 1090 annealed steel, 1095 annealed steel, and/or full hard stainless steel) which provides sufficient strength to the first half 104 and its sections (e.g., the spring arm 120) that are designed to deform and then return back to their original shape when in use. Similarly, the first half 104 preferably has a Rockwell C rating of approximately 40/50. Lastly, the metal sheet from which the first half 104 and the second half 108 are formed typically includes a height 214 and a width 206. Preferably, the height 214 is approximately 3.95 inches, however in some embodiments the height may be approximately within the range of 2-6 inches. Similarly, the width 206 preferably is approximately 1.10 inches, but in other embodiments, the width 206 may range approximately from 0.8-2.2 inches.

Figure 7:
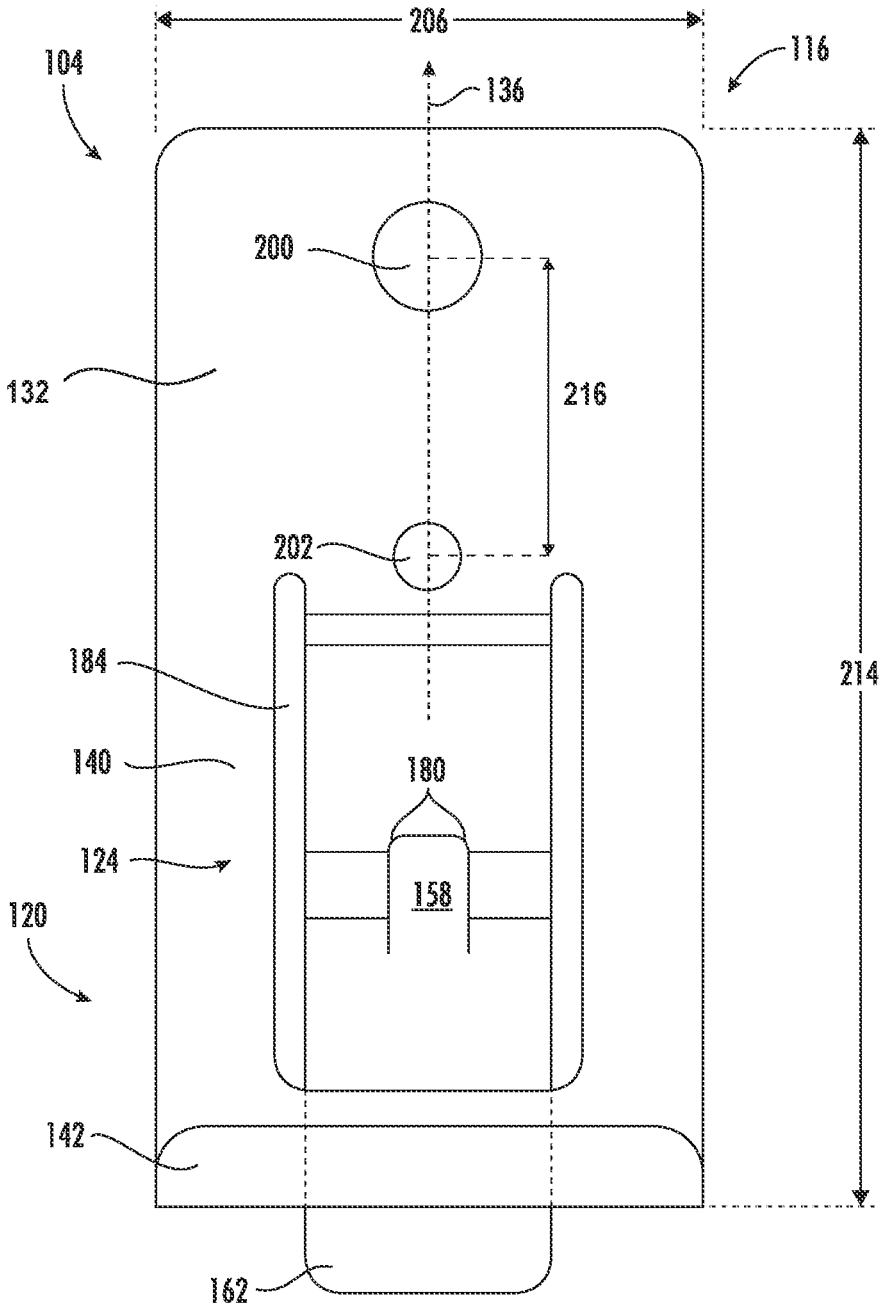
FIG. 7 is a front view of the first half of a ceiling tile control and grid support clip, according to another example embodiment.

As described herein, the support section 116 is configured to both receive the fastener 112 and to couple to the facility support structure. To do so, the support section 116 includes a vertical portion 132 extending vertically upward along a vertical axis 136, a first aperture 200 formed within the vertical portion 132, and a second aperture 202 formed within the vertical portion 132. As described herein, when the first half 104 is manufactured the support section 116 receives no significant stamping (e.g., no angling formed therein) such that the vertical portion 132 is substantially straight and collinear with the vertical axis 136. Preferably, during the manufacturing process, the vertical portion 132 has the first aperture 200 and the second aperture 202 cut-out. The first aperture 200 is preferably configured to couple the first half 104 and the ceiling clip 100 to the facility support structure. Preferably, the first aperture 200 receives a first end of a hanger or wire therein which is coupled to the facility support structure at a second end. In some embodiments, the diameter of the first aperture 200 is approximately 0.25 inches and the first aperture 200 preferably receives a hanger with a diameter that is approximately the same as the aperture 200. In other embodiments, the diameter of the first aperture 200 is approximately within the range of 0.1-0.38 inches. The second aperture 202 is positioned below the first aperture 200 in the support section 116 and preferably receives the fastener 112 therein to couple the first half 104 to the second half 108. The diameter of the second aperture 202 is preferably approximately 0.128 or 0.130 inches and the diameter of the fastener 112 is approximately the same as the second aperture 202. In other embodiments, the diameter of the second aperture 202 may have a diameter within the range of 0.05-0.30 inches. Preferably, the diameter of the first aperture 200 is larger than the diameter of the second aperture 202, however it is not necessary that the diameter of the first aperture is larger than the diameter of the second aperture. As described herein, the second aperture 202 is cutout a distance 216 below the first aperture 200 in the support section 116. In some embodiments, the distance 216 is 0.40 inches. Still in other embodiments, referring now to FIG. 7, the distance 216 is 0.82 inches. The distance between the second aperture 202 and the bulb retention section 124 affects the compressive spring force between the two, opposed bulb retention sections 124. The larger the distance 216 between the first aperture 200 and the second aperture 202 the greater the compressive spring force. In some embodiments, the position of the second aperture 202 is based on a desired compressive spring force.

Referring back to FIGS. 4-6 according to an example embodiment, during the stamping operation, a substantially rectangular central tab is formed by making a U-shaped cut through the center of the lower portion of each half 104 and 108. This creates the bulb retention section 124 surrounded on three edges by the remainder of the stamping which will be manipulated to create the spring arm 120 at a point of separation. The vertical portion 132 extends straight and vertically (e.g., along the vertical axis 136) from a topmost point of the first half 104 to the point of separation at which the spring arm 120 separates from the bulb retentions section 124.

Each spring arm 120 is configured to come into contact with a single ceiling tile 18 and to provide spring resistance against the movement of the ceiling tile 18 (e.g., from being dislodged from its desired position resting on the flanges 38). To do so, the spring arm 120 includes the angled portion 140 which is relatively U-shaped and includes the hollow portion 184 therein from which the bulb retention section 124 was stamped. Furthermore, the spring arm 120 includes at the terminal end an arcuate tip 140 which is curved upwardly. The angled portion 140 is a bent and cut part of the vertical portion 132 that is provided at an angular offset 144 with respect to the vertical axis 136. The angular offset 144 may be approximately 140 degrees from the vertical axis 136. In other embodiments, the angular offset 144 may be approximately within the range of 130-170 degrees from the vertical axis 136. Similarly, the angled portion 140 extends substantially straight and outward from the rest of the first half (i.e., the support section 116 and the bulb retention section 124) until reaching the arcuate tip 140 provided at the terminal end of the spring arm 120. Furthermore, the angled portion 140 extends both downwardly and laterally outwardly from the vertical portion 132 and the support section 116. With this configuration, when the ceiling clip 100 is installed on the grid, the arcuate tip 140 is adapted to contact the uppermost surface of the adjacent ceiling tile and the contoured end of arcuate portion 142 provides a smooth, arcuate surface for contact with the top, unseen surface of the ceiling tile.

Figure 10:
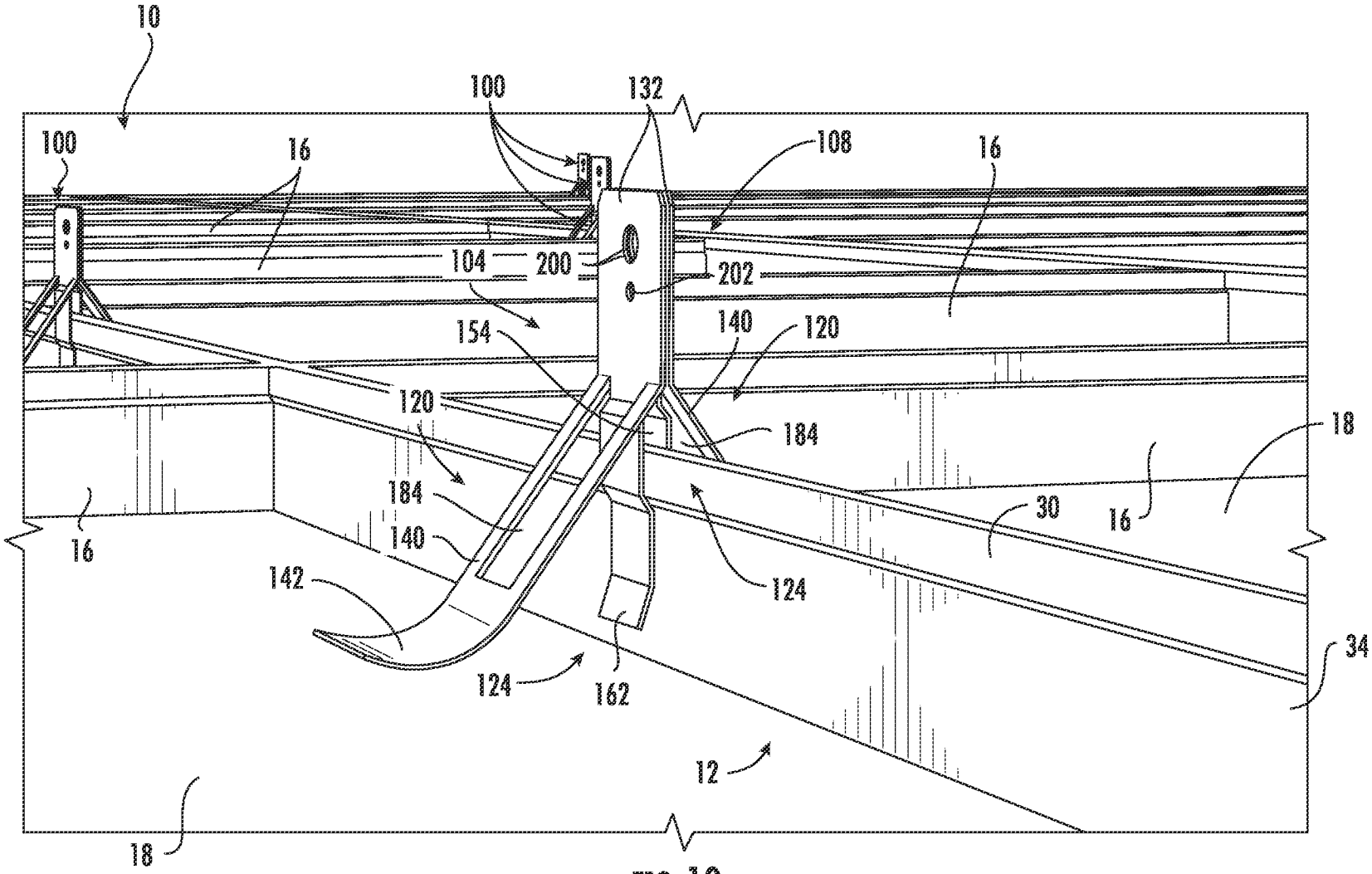
FIG. 10 is a perspective view of the ceiling tile control and grid support clip of FIG. 3 attached to the main runner of FIG. 2.

Commonly, ceiling tiles can be dislodged from the desired, installed position contacting and supported by the flanges 38 (i.e., such that they do not sit evenly within the drop ceiling system 10). To then realign the dislodged ceiling tile, a person must locate some means to reach or access the dislodged ceiling tile and put it back into place. This can be time consuming and difficult if the person does not have easy access to a ladder or a lift. As seen in FIG. 10, the ceiling clip 100 is mounted to the main runner 12 so that the spring arm 120 of the first half 104 extends outwardly from the other sections and contacts the ceiling tile 18 while the spring arm 120 of the second half 108 contacts the adjacent ceiling tile on the other side of the main runner 12. Additionally, because the spring arm 120 includes the relatively thin angled portion 140 and the arcuate tip 140, the spring arm 120 is able to bend and provide a counter spring force to resist any inadvertent force applied to the ceiling tile. Therefore if something inadvertently comes into contact with the ceiling tile 18 that the spring arm 120 is in contact with, the spring arm 120 absorbs the force of the contact and pushes the ceiling tile 18 back down into the desired, installed position. This keeps the ceiling tile 18 in place against inadvertent force or contact with the ceiling tile 18 while permitting the intentional movement or removal of the ceiling tile for maintenance or access to the area above the tiles and grid.

Still referring to FIGS. 4-6, the first half 104 (and the second half 108) further include the bulb retention section 124. The bulb retention section 124 cooperates with the opposing bulb retention section 124 of the other half of the clip 100 to create the cavity 154 which is configured to receive and grip the bulb 30 of the runner to couple the ceiling clip 100 to the runner. To do so, each bulb retention section 124 is defined by and includes multiple portions and contours that form the shape of the retention section 124. For example, the bulb retention section 124 includes multiple curved and straight portions such as a bulb receiving portion 162 which is located proximate the bottom of the bulb retention section 124.

During the stamping operation, another U-shaped cut is applied to the bulb retention section 124 to form a retaining tab 158 (See FIGS. 3-6). The retaining tab 158, similar to the bulb retention section 124, is therefore surrounded on three edges by one or more of the portions of the bulb retention section 124 and includes a width 182. The retaining tab 158 extends relatively straight and vertically up into the cavity 154 when the first half 104 is coupled to the second half 108 and is configured to grip, catch, or engage the bottom surface of the bulb 30 of the runner. In this way, the retaining tab 158 may catch on one side of the bulb 30 and the opposite retaining tab 158, of the other half, may catch on the opposite side of the bulb 30 to couple the ceiling clip 100 to the bulb 30 and resist removal of the clip 100 from the runner.

Preferably, the retaining tab 158 includes multiple rounded corners or edges 180 to provide better retention of the retaining tab 158 on the bulb 30 but also to allow for longitudinal movement along the runner. Specifically, the rounded corners 180 of the retaining tab 158 make it easier to slide or reposition the ceiling clip 100 along the length of the runner and can facilitate easier removal of ceiling tiles. When removing a ceiling tile the tile need only be lifted enough to provide access to the ceiling clip 100 which is then easily moved by sliding along the runner to allow room for removing the tile.

As seen in FIG. 4, following the forming operation, but before assembly to one another, portions of each half (104 and 108) of the clip include some angular offset and this offset provides the desired spring force in the bulb retention section 124 of the assembled ceiling clip 100. Specifically, the bulb retention section 124 is by an offset 166 which may be approximately 20 degrees from the vertical axis 136 towards the opposing half of the assembled ceiling clip. This angular offset 166 may be approximately within the range of 10-30 degrees from the vertical axis 136. In the assembled state, the first half 104 and the second half 108 are coupled to one another via the fastener 112 so that the vertical portions 132 and portions of the opposing bulb retention sections 124 of each half are in direct contact with one another. As noted above, each half 104 and 108 are formed from spring steel so that the compressive force of fastener 112 coupled with the greater mass of the opposing vertical portions 132 elastically deforms the offset of the two bulb retention sections 124. The net result of the elastic deformation is to create a clamping, compressive spring force between the two, opposed bulb retention sections 124 and this spring force serves to assist in the retention or grip of the bulb retention sections 124 on the runner in the installed position. As each half cooperates with one another to grip the bulb 30 and the vertical web 34 of the runner from opposite directions, the ceiling clip 100 provides a strong and consistent grip to the runner to both hold the ceiling clip 100 in place and provide a suitable means for providing additional support points between the grid and the structure of the facility. It is important to note that the entirety of the ceiling clip 100 is positioned vertically above the grid and the ceiling tiles. So, when the tiles are in the installed, desired position, no portion of the ceiling clip 100 is visible to an observer positioned below.

During the stamping, cutting and bending operations, it is desirable to impose a small, lateral offset bend in the terminal end 162 of the bulb retention section 124 for each half 104 and 108. Ideally, each terminal end 162 is angled approximately 10 degrees from the vertical axis 136. As a result and when the two halves are coupled, each of the bulb receiving portions 162 extends slightly horizontally outward and forms a tapered opening into which the bulb 30 is first received when the ceiling clip 100 is installed. The tapered opening formed by the bulb receiving portions 162 allows the ceiling clip 100 to be pressed onto the bulb 30 to couple the ceiling clip 100 and the runner.

Figure 8:
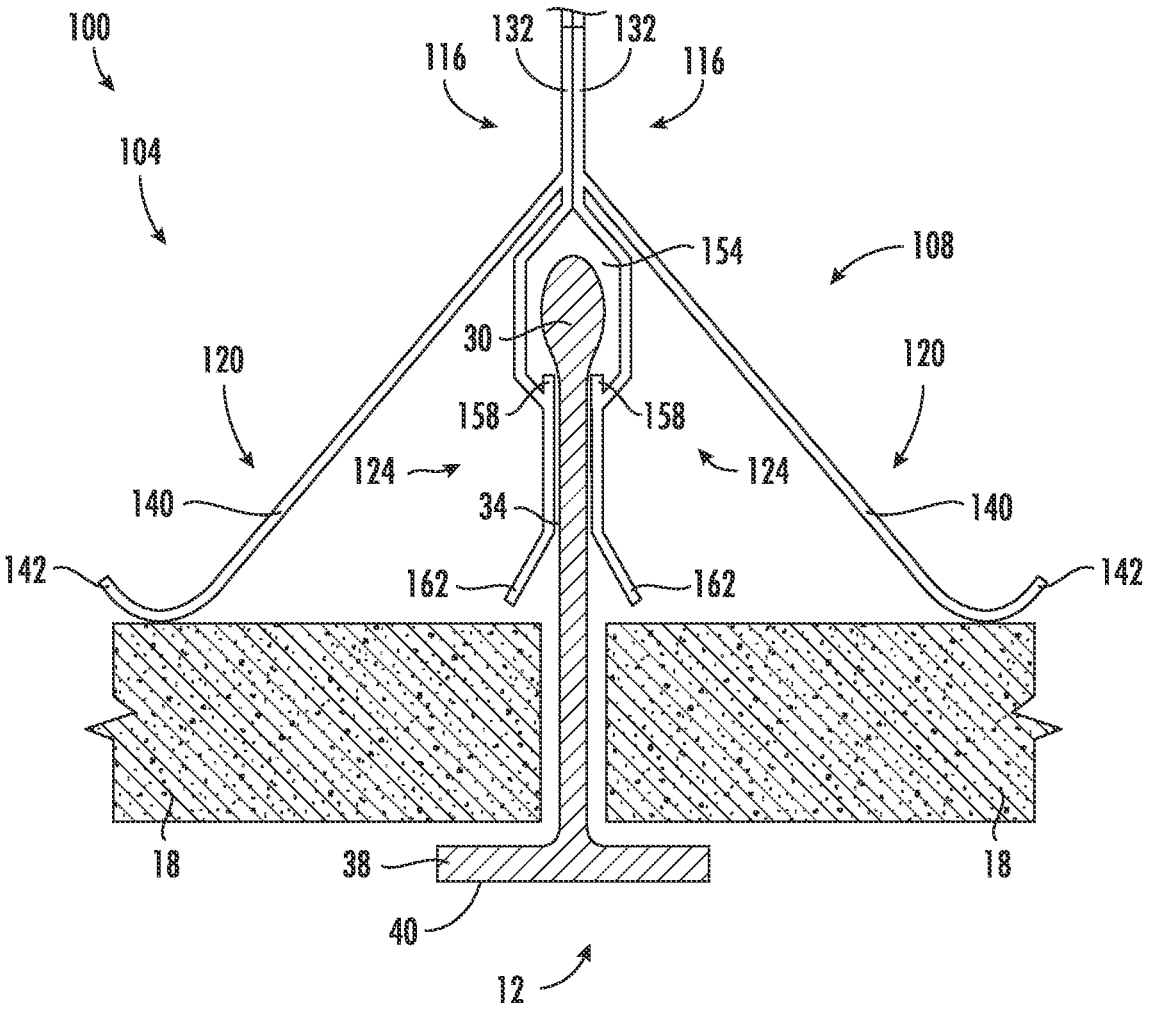
FIG. 8 is a front view of the ceiling tile control and grid support clip of FIG. 3 attached to the main runner of FIG. 2.

Referring now to FIG. 8, the ceiling clip 100 is shown installed on the main runner 12 of FIG. 2. When installed, the bulb retention section 124 and the retaining tabs 158 grip the bulb 30 and the vertical web 34 to prevent vertical movement of the ceiling clip 100 while still allowing longitudinal sliding movement along the length of the runner 12. The ceiling clip 100 may be installed in two separate ways. First, the first half 104 and the second half 108 may be first assembled via the fastener 112. Then, the bulb receiving portions 162 which extend slightly horizontally outward and form a tapered opening may be pushed over the bulb 30 and slid down, onto the vertical web 34 until the bulb 30 is received within the cavity 154 and each retaining tab 158 engages and grips the bottom edge of the bulb 30. At this point, the ceiling clip 100 is coupled to the main runner 12 and the person who installed the ceiling clip 100 may choose to provide additional support to the main runner 12 by coupling the support section 116 to the facility support.

In the second installation method, the first half 104 and the second half 108 are coupled on site. Specifically, each half is positioned (while uncoupled) on opposite sides of the main runner 12 such that the retaining tabs 158 are contacting the bulb 30. Next, the first half 104 and the second half 108 are coupled to one another via the fastener 112 such that the cavity 154 is formed around and retains the bulb 30. At this point, the ceiling clip 100 is coupled to the main runner 12 and the person who installed the ceiling clip 100 may choose to provide additional support to the main runner 12 by coupling the support section 116 to the facility support.

Beneficially, because the ceiling clip 100 is configured to both prevent the ceiling tiles 18 from moving and to also provide additional support to the runner, the ceiling clip 100 provides multiple, diverse functions from a single clip. Additionally, the ceiling clip 100 provides means to provide additional vertical support for the runner, without drilling through the runner or some other steps which deform and potentially degrade the structural integrity of the runner. This preserves the aesthetic look of the drop ceiling system 10 and prevents the ceiling tile 18 from sitting unevenly on the flange 38. For example, if the ceiling clip 100 were to contact the flange 38, the ceiling tile 18 may sit unevenly on the flange 38 and look uneven in the drop ceiling system 10. Furthermore, because the ceiling clip 100 provides increased support for the runner, the clip 100 may be used to selectively support runners on which the load has changed over time. For example, if a company is looking to hang a promotional banner from the drop ceiling system 10 (i.e., provide a change in load), the ceiling clip 100 may be installed to provide improved strength and support to the runner on which the load will be supported.

Figure 9:
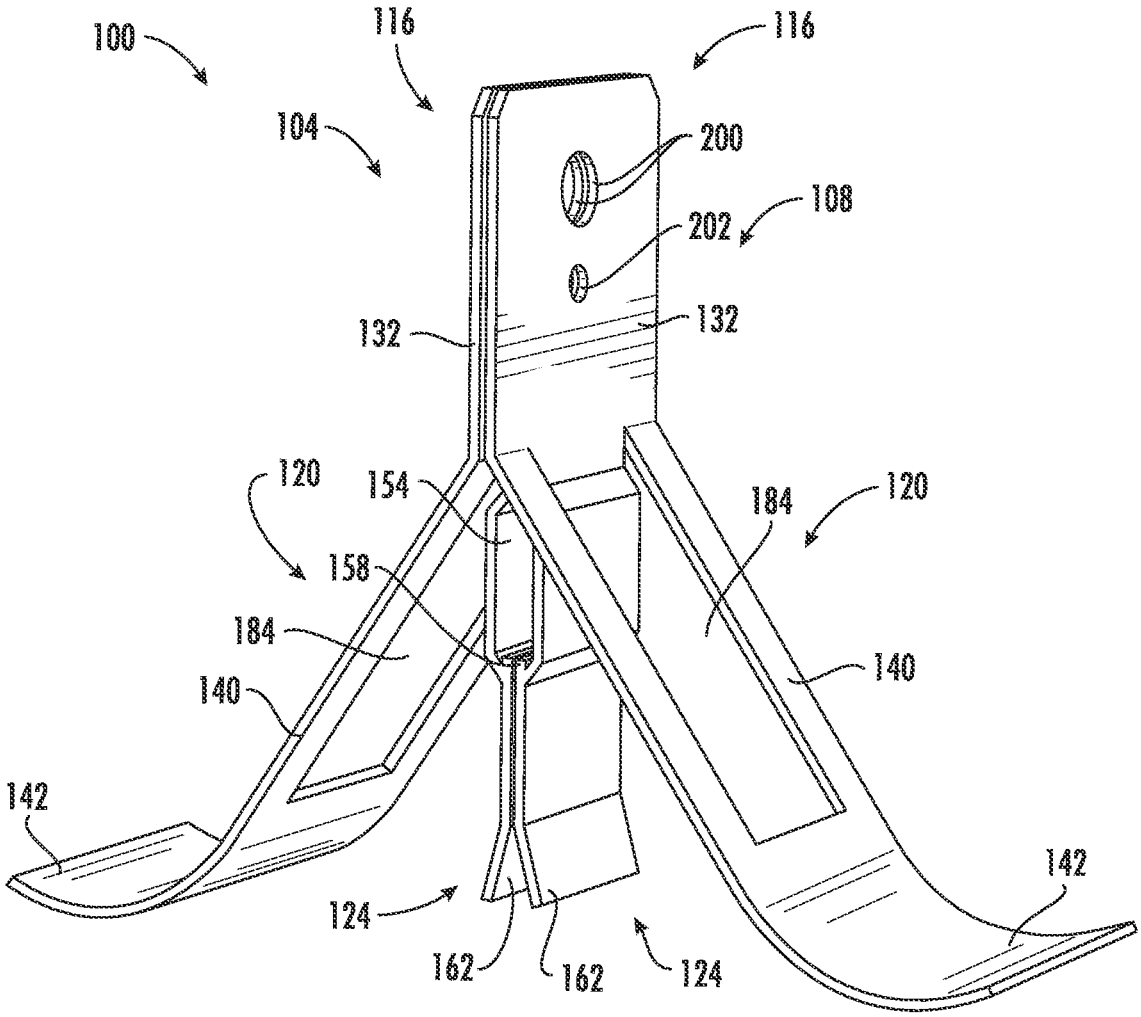
FIG. 9 is a perspective view of the ceiling tile control and grid support clip of FIG. 3.

Referring to FIGS. 8-9, the ceiling clip 100 is shown from a perspective view. As shown in FIG. 10, multiple ceiling clips 100 can be used within the drop ceiling system 10 to control multiple ceiling tiles 18. In one example, two ceiling clips 100 are used for each ceiling tile 18 (i.e., one ceiling clip 100 on the main runner 12 and one on opposing main runner 12 adjacent the respective ceiling tile 18). In another embodiment, four ceiling clips 100 can be used for each ceiling tile 18 (i.e., one ceiling clip 100 on each runner adjacent the respective ceiling tile 18). In this way, each ceiling tile 18 of the drop ceiling can be held in place and the runners that require extra support can be supported via the ceiling clip 100.

As utilized herein with respect to numerical ranges, the terms "approximately," "about," "substantially," and similar terms generally mean+/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above.

It is important to note that any element disclosed in one embodiment may be incorporated or utilized with any other embodiment disclosed herein.

What is claimed is:

1. A clip for use with a runner of a drop ceiling comprising:

a discrete first half comprising:

a first support section at an upper portion of the first half above the runner comprising a first fastener aperture and a first support aperture;

a first control section angularly biased from and extending below the first support section to an adjacent first ceiling tile and configured to contact the adjacent first ceiling tile of the drop ceiling; and a first retaining section below the first support section and substantially adjacent the runner comprising a first retaining tab configured to impede movement of a first side of a bulb of the runner;

a discrete second half comprising:

a second support section at an upper portion of the second half above the runner comprising a second fastener aperture and a second support aperture;

a second control section angularly biased from and extending below the second support section to an adjacent second ceiling tile and configured to contact the adjacent second ceiling tile of the drop ceiling; and a second retaining section below the second support section and substantially adjacent the runner comprising a second retaining tab configured to grip a second side of the bulb of the runner, the second side opposite the first side;

a fastener received within the first and second fastener apertures configured to couple the first half to the second half; and a support element received within the first and second support apertures configured to couple the clip to an external support.

2. The clip of claim 1, wherein the first retaining section is angularly biased from the first support section by a first angle within a range of 10-20 degrees when the first half is coupled to the second half and wherein the second retaining section is angularly biased from the second support section by a second angle opposite the first angle when the first half is coupled to the second half.

3. The clip of claim 1, when the first half and the second half are coupled, the first retaining section and the second retaining section define a hollow portion disposed between the first retaining section and the second retaining section.

4. The clip of claim 1, wherein the first retaining section further comprises a first bottom portion, wherein the second retaining section comprises a second bottom portion, and wherein the first bottom portion and the second bottom portion form a tapered opening when the first half and the second half are coupled.

5. The clip of claim 1, wherein the first retaining section and the second retaining section are configured to couple the clip to the runner without gripping a flange of the runner.

6. The clip of claim 1, wherein each support aperture has a larger diameter than each fastener aperture.

7. The clip of claim 1, wherein the first and second support apertures are configured to receive the support element therein, the support element comprising a wire to couple the clip to the external support.

8. The clip of claim 7, wherein the first and second support apertures have a larger diameter than the first and second fastener apertures.

9. The clip of claim 1, wherein the first support section further comprises a first vertically extending portion extending straight along a substantially vertical axis and having a support section width perpendicular to the vertical axis, wherein the first control section comprises a spring arm having a spring arm width perpendicular to the vertical axis and defining a cutout having a cutout width perpendicular to the vertical axis, wherein the first retaining section has a retaining section width perpendicular to the vertical axis, and wherein the retaining section width is less than or equal to the cutout width.

10. The clip of claim 9, wherein the support section width and the spring arm width are equal.

11. The clip of claim 1, wherein in an installed position, each support section extends along a substantially vertical axis and includes a vertical height within a first range of 0.5-2.0 inches.

12. The clip of claim 11, wherein each control section includes a spring arm angularly offset from the substantially vertical axis by a first angle within a second range of 130-170 degrees.

13. The clip of claim 12, wherein each spring arm comprises a straight portion and an arcuate portion.

14. The clip of claim 13, wherein each retaining section includes a bulb receiving portion angularly offset from the substantially vertical axis by a second angle within a third range of 10-30 degrees.

15. The clip of claim 14, wherein the second angle is approximately 20 degrees.

16. A drop ceiling comprising:

a plurality of runners, each runner comprising:

a substantially vertical web having a bulb at a top of the vertical web and a substantially horizontal flange projecting laterally outward from a lower portion of the vertical web;

a first ceiling tile supported by one or more of the horizontal flanges of the plurality of runners; and the clip of claim 1 coupled to a first runner of the plurality of runners.

17. The drop ceiling of claim 16, further comprising a second ceiling tile supported by one or more horizontal flanges of the plurality of runners, wherein each control section comprises a spring arm configured to contact a respective said ceiling tile and located vertically below the retaining tab.

18. The drop ceiling of claim 16, wherein the clip couples to the first runner without gripping the horizontal flange of the first runner.

19. The drop ceiling of claim 16, wherein each runner of the plurality of runners is at least one of a main runner an a cross runner.

* * * * *